US008518192B2

(12) United States Patent
Misra et al.

(10) Patent No.: US 8,518,192 B2
(45) Date of Patent: Aug. 27, 2013

(54) LEAD-FREE, HIGH-STRENGTH, HIGH-LUBRICITY COPPER ALLOYS

(75) Inventors: Abhijeet Misra, Evanston, IL (US); Jason Sebastian, Chicago, IL (US); James A. Wright, Chicago, IL (US)

(73) Assignee: QuesTek Innovations, LLC, Evanston, IL (US)

( * ) Notice: Subject to any disclaimer, the term of this patent is extended or adjusted under 35 U.S.C. 154(b) by 0 days.

(21) Appl. No.: 13/202,805

(22) PCT Filed: Mar. 2, 2010

(86) PCT No.: PCT/US2010/025893

§ 371 (c)(1), (2), (4) Date: Aug. 23, 2011

(87) PCT Pub. No.: WO2010/101899

PCT Pub. Date: Sep. 10, 2010

(65) Prior Publication Data

US 2011/0303387 A1 Dec. 15, 2011

Related U.S. Application Data

(60) Provisional application No. 61/157,023, filed on Mar. 3, 2009.

(51) Int. Cl.
*C22C 9/00* (2006.01)

(52) U.S. Cl.
USPC ..... 148/433; 420/472; 420/499

(58) Field of Classification Search
USPC ..... 148/433; 420/472, 499
See application file for complete search history.

(56) References Cited

U.S. PATENT DOCUMENTS

| | | | | |
|---|---|---|---|---|
| 4,551,395 | A * | 11/1985 | Lloyd | 428/677 |
| 5,167,726 | A | 12/1992 | LoIacono et al. | |
| 5,242,657 | A | 9/1993 | Sahu | |
| 5,286,444 | A | 2/1994 | Tomikawa et al. | |
| 5,288,458 | A | 2/1994 | McDevitt et al. | |
| 5,330,712 | A | 7/1994 | Singh | |
| 5,413,756 | A | 5/1995 | Sahu | |
| 5,487,867 | A | 1/1996 | Singh | |
| 5,614,038 | A | 3/1997 | King et al. | |
| 5,846,483 | A | 12/1998 | Venugopalan et al. | |

(Continued)

FOREIGN PATENT DOCUMENTS

| | | | |
|---|---|---|---|
| EP | 0224619 | A1 | 6/1987 |
| EP | 1717325 | A1 | 11/2006 |

(Continued)

OTHER PUBLICATIONS

International Search Report and Written Opinion mailed May 18, 2010(PCT/US2010/025893); ISA/EP.

(Continued)

*Primary Examiner* — Sikyin Ip
(74) *Attorney, Agent, or Firm* — Banner & Witcoff, Ltd.

(57) ABSTRACT

A lead-free copper alloy includes, in combination by weight, about 10.0% to about 20.0% bismuth, about 0.05% to about 0.3% phosphorous, about 2.2% to about 10.0% tin, up to about 5.0% antimony, and up to about 0.02% boron, the balance essentially copper and incidental elements and impurities. The alloy contains no more than about 0.05 wt. % or 0.10 wt. % lead.

12 Claims, 1 Drawing Sheet

(56) References Cited

U.S. PATENT DOCUMENTS

| | | | |
|---|---|---|---|
| 5,942,056 | A | 8/1999 | Singh |
| 6,025,081 | A | 2/2000 | Ohshiro et al. |
| 6,059,901 | A | 5/2000 | Sahu |
| 6,254,701 | B1 | 7/2001 | Oshiro et al. |
| 6,419,766 | B1 | 7/2002 | Ikemiya et al. |
| 6,451,452 | B1 | 9/2002 | Niegel et al. |
| 6,543,333 | B2 | 4/2003 | Griffin et al. |
| 6,599,378 | B1 | 7/2003 | Hagiwara et al. |
| 6,602,615 | B2 | 8/2003 | Sakai et al. |
| 6,746,154 | B2 | 6/2004 | Greene et al. |
| 6,854,183 | B2 | 2/2005 | Greene et al. |
| 6,926,779 | B1 | 8/2005 | Bin |
| 2003/0068106 | A1 | 4/2003 | Greene et al. |
| 2009/0003740 | A1 | 1/2009 | Schubert et al. |

FOREIGN PATENT DOCUMENTS

| | | | | |
|---|---|---|---|---|
| GB | 2355016 | A | | 4/2001 |
| JP | 57073147 | A | * | 5/1982 |
| JP | 08120369 | A | | 5/1996 |
| WO | 9424324 | A1 | | 10/1994 |
| WO | 2005080620 | A1 | | 9/2005 |

OTHER PUBLICATIONS

Stakeholder consultation on adaptation to scientific and technical progress under directive 2002/95/ec on the restriction of the use of certain hazardous substances in electrical and electronic equipment for the purpose of a possible amendment of the annex exemption 9b (lead in lead-bronze bearing shells and bushes), available at http://rohs.exemptions.oeko.info/fileadmin/user_upload/Stakeholder_comments/Exemption_9b_Emerson_20_March_2008. pdf.

Notification of the First Office Action in the Chinese application No. 201080010519.8 dated Dec. 24, 2012.

* cited by examiner

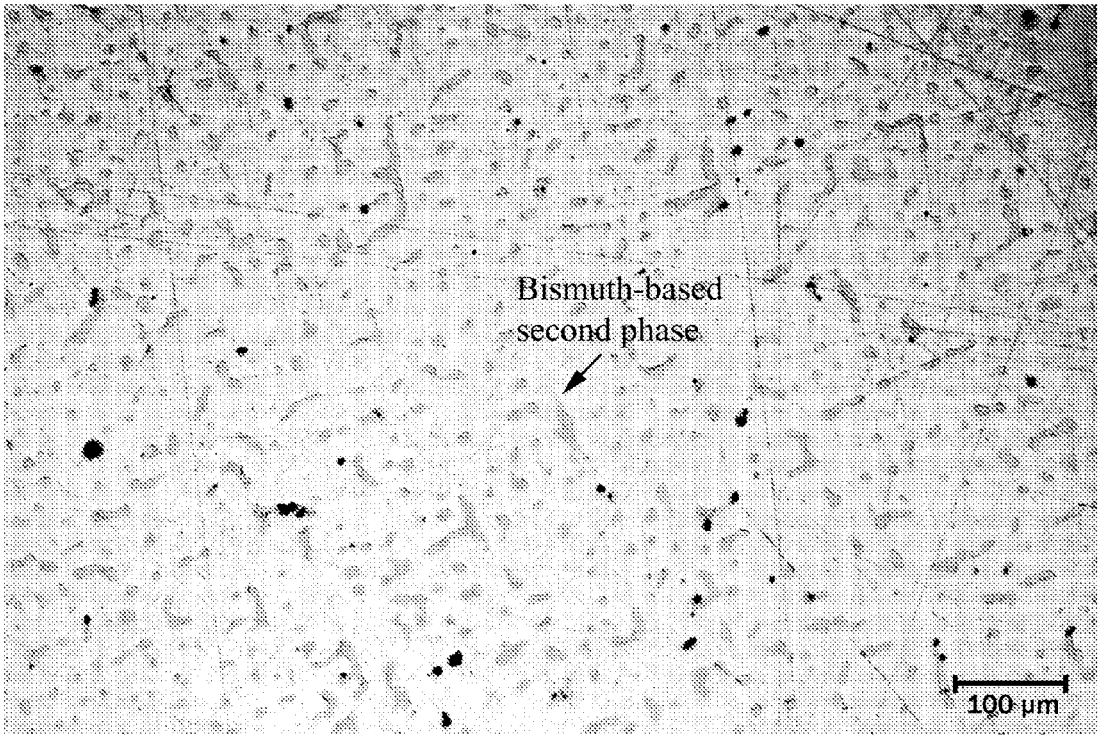
Bismuth-based
second phase
100 μm

LEAD-FREE, HIGH-STRENGTH, HIGH-LUBRICITY COPPER ALLOYS

CROSS-REFERENCE TO RELATED APPLICATION

The present application is a U.S. National Phase filing of International Application No. PCT/US2010/025893 filed on Mar. 2, 2010, designating the United States of America and claiming priority to U.S. Provisional Patent Application No. 61/157023, filed on Mar. 3, 2009, both of which applications the present application claims priority to and the benefit of, and both of which applications are incorporated by reference herein in their entireties.

TECHNICAL FIELD

The invention relates generally to copper alloys, and more specifically, to copper-bismuth alloys having high strength, ductility, and lubricity.

BACKGROUND

Copper alloys containing 20-30 wt. % lead, also known as highly-leaded bronze, are commonly used due to benefits such as high strength, high ductility, high melting temperature, and high lubricity. Highly-leaded bronze is often used in rotating shaft bearings such as plain journal bearings or sleeve bearings, where the presence of adequate additional lubrication fluid is uncertain or periodically interrupted. The lubricity in highly-leaded bronze is provided by a lead-based second phase which forms during solidification. The lubricity is at least partially proportionate to the volume fraction of this lead-based second phase, which in turn is proportionate to the amount of lead in the alloy.

Due to health and environmental regulations, some of which are pending at the moment, it can be desirable to substantially reduce or eliminate the use of lead in copper alloys. To be called "lead-free," lead must constitute less than 0.10 wt. % of the alloy. However, lead-free substitutes for highly-leaded bronze have not been forthcoming. As a result, manufacturers frequently request exemptions from regulations for the use of highly-leaded bronze. For example, a leading manufacturer of compressors used in air-conditioning and heat pumps has recently requested to continue the exemption (9b) for "lead in lead-bronze bearing shells and bushes" from the Restriction of Hazardous Substances directive. Thus, there has developed a need for lead-free, high-strength, high-lubricity copper alloys.

BRIEF SUMMARY

Aspects of the invention relate to a lead-free copper alloy that includes, in combination by weight, about 10.0% to about 20.0% bismuth, about 0.05% to about 0.3% phosphorous, about 2.2% to about 10.0% tin, up to about 5.0% antimony, and up to about 0.02% boron, the balance essentially copper and incidental elements and impurities. The alloy contains no more than about 0.10 wt. % lead.

According to one aspect, the alloy contains less than 0.05 wt. % lead.

According to another aspect, the alloy contains about 12.0 wt. % bismuth, about 2.4 wt. % to 3.1 wt. % tin, about 1.0 wt. % antimony, about 0.1 wt. % phosphorous, and about 0.01 wt. % boron, or the alloy contains about 12.0 wt. % bismuth, about 5.5 to about 6.2 wt. % tin, about 0.1 wt. % phosphorous, up to about 0.05 wt. % lead, and up to about 0.01 wt. % boron.

According to a further aspect, the alloy has a phase fraction of $Cu_3Sn$ of below about 0.15 (i.e. 15 vol. %), a phase fraction of CuSb of below about 0.15 (i.e. 15 vol. %), and a phase fraction of $Cu_3P$ of below about 0.01 (i.e. 1 vol. %).

According to yet another aspect, the alloy has an ultimate tensile strength (UTS) in the range of about 90-210 MPa (13-31 ksi), a yield strength in the range of about 80-120 MPa (12-17 ksi), and an elongation in the range of about 1-20%.

According to a still further aspect, the alloy further contains at least one rare earth element in a form selected from a group consisting of: elemental lanthanum, elemental cerium, and mischmetal, and any combination thereof.

Additional aspects of the invention relate to a lead-free copper alloy that includes, in combination by weight, about 10.0% to about 20.0% bismuth, about 0.05% to about 0.3% phosphorous, about 2.2% to about 10.0% tin, up to about 5.0% antimony, up to about 0.02% boron, and at least one rare earth element in a form selected from a group consisting of: elemental lanthanum, elemental cerium, and mischmetal, and any combination thereof, with the balance essentially copper and incidental elements and impurities. The alloy contains up to about 0.10 wt. % lead. Additionally, the alloy contains a volume fraction of a bismuth-based phase of at least 0.04.

Further aspects of the invention relate to a method that includes casting billet formed of an alloy composed of about 10.0% to about 20.0% bismuth, about 0.05% to about 0.3% phosphorous, about 2.2% to about 10.0% tin, up to about 5.0% antimony, and up to about 0.02% boron, the balance essentially copper and incidental elements and impurities, with no more than about 0.10 wt. % lead. The billet is then cooled to room temperature and solidified.

According to one aspect, the billet is cast by centrifugal casting, to near net shape. According to another aspect, the billet is cooled to room temperature at a rate of about 100° C. per minute. According to a further aspect, the billet is cast by direct-chill casting and cooled with water.

Other features and advantages of the invention will be apparent from the following description taken in conjunction with the attached drawing.

BRIEF DESCRIPTION OF THE DRAWINGS

To allow for a more full understanding of the present invention, it will now be described by way of example, with reference to the accompanying drawing in which:

FIG. 1 is an optical micrograph showing one embodiment of the present invention.

DETAILED DESCRIPTION

In general, the present invention relates to ductile lead-free Cu—Bi alloys which contain more than 10 wt. % Bi. Copper alloys containing 2-9 wt. % Bi, disclosed in U.S. Pat. No. 5,413,756, which is incorporated by reference herein and made part hereof, have been used as bearing material, but the lubricity of those alloys is generally lower compared to highly-leaded bronze. The lower lubricity is due to a low volume fraction of lubricous bismuth-based second phase. Prior efforts to increase the bismuth content of copper alloys to above 10 wt. % resulted in the bismuth-based second phase segregating to the grain-boundary region, which in turn decreased the ductility of the alloys. In some embodiments, the Cu—Bi alloys disclosed herein employ alloying additions of tin, antimony, and/or phosphorus, which can assist in avoiding this problem.

In one embodiment, a Cu—Bi alloy contains about 10.0 wt. % to about 20.0 wt. % bismuth, about 2.2 wt. % to about 10 wt. % tin, up to about 5.0 wt. % antimony, about 0.05 wt. % to about 0.3 wt. % phosphorous, and up to about 0.02 wt. % boron, the balance essentially copper and incidental elements and impurities. In this embodiment, the alloy is "lead-free", which signifies that the alloy contains less than 0.10 wt. % lead, or in another embodiment, less than 0.05 wt. % lead. The alloy may contain a small but effective amount of rare-earth elements to help getter some impurities. Such rare-earth elements may be added by mischmetal (which may contain a mix of cerium and/or lanthanum, as well as possibly other elements), or elemental cerium or lanthanum, or a combination of such forms. In one embodiment, the alloy contains an aggregate content of such rare earth elements of about 0.02 wt. %.

In another embodiment, a Cu—Bi alloy contains about 12.0 wt. % bismuth, about 2.4 wt. % to 3.1 wt. % tin, about 1.0 wt. % antimony, about 0.1 wt. % phosphorous, and about 0.01 wt. % boron, the balance essentially copper and incidental elements and impurities. In this embodiment, the alloy is "lead-free," which signifies that the alloy contains less than 0.10 wt. % lead. In other embodiments, this nominal composition may incorporate a variation of 5% or 10% of each stated weight percentage. FIG. 1 is an optical micrograph showing this embodiment.

In a further embodiment, a Cu—Bi alloy contains about 12.0 wt. % bismuth, about 5.5 to about 6.2 wt. % tin, about 0.1 wt. % phosphorous, up to about 0.05 wt. % lead, and up to about 0.01 wt. % boron, the balance essentially copper and incidental elements and impurities. In other embodiments, this nominal composition may incorporate a variation of 5% or 10% of each stated weight percentage.

Alloys according to various embodiments may have advantageous physical properties and characteristics, including high strength, high ductility, high melting temperature, and high lubricity. The alloy may have an ultimate tensile strength (UTS) in the range of about 90-210 MPa (13-31 ksi), a yield strength in the range of about 80-120 MPa (12-17 ksi), and an elongation in the range of about 1-20%. In another embodiment, the alloy may have a UTS in the range of about 140-210 MPa (21-31 ksi), a yield strength in the range of about 80-120 MPa (12-17 ksi), and an elongation in the range of about 7-20%. Additionally, the alloy may have a melting temperature of about 1000° C. Further, the lubricity of the alloy may be comparable to that of lead-containing copper alloys, such as highly-leaded bronze.

In one embodiment, the alloy has a higher volume fraction of a bismuth-based second phase, as compared to existing Cu—Bi alloys. This can increase the lubricity of the alloy, as the bismuth-based second phase has high lubricity. The volume fraction of the bismuth-based second phase in the alloy is at least 0.04 (i.e. 4 vol. %) in one embodiment. In one embodiment, it may be desirable for the bismuth-based second phase to be separated and distributed in the Cu matrix, and for interconnection of the phase particles to be limited, as illustrated in FIG. 1. Alloying additions of tin, antimony, and/or phosphorus, can assist in avoiding segregation of the bismuth-based second phase to the grain-boundary regions. As stated above, such segregation can decrease the ductility of the alloy. Additionally, Cu—Bi alloys disclosed herein promote liquid immiscibility. When two liquids are immiscible, the liquid with a lower solidification temperature (i.e. Bi) is generally less likely to segregate to the grain boundaries of the solid formed from the other liquid (i.e. Cu). Applying this approach to Cu—Bi alloys used in casting, grain-boundary segregation can be prevented and high ductility can be achieved. To promote the liquid immiscibility, some embodiments of the disclosed alloys contain appropriate alloying additions of tin, antimony, and phosphorus.

To provide for an appropriate level of ductility, Cu—Bi alloys disclosed herein can also limit the formation of detrimental phases, such as $Cu_3Sn$, CuSb, and/or $Cu_3P$. In some embodiments, the phase fraction of $Cu_3Sn$ is limited to below about 0.15 (i.e. 15 vol. %), the phase fraction of CuSb limited to below about 0.15 (i.e. 15 vol. %), and the phase fraction of $Cu_3P$ limited to below about 0.01 (i.e. 1 vol. %). This can be achieved by limiting the additions of tin to below about 10.0 wt. %, antimony to below about 5.0 wt. %, and phosphorus to below about 0.3 wt. %. It is noted that at least some of these intermetallic phases are present in the sample shown in FIG. 1, but these phases are not revealed by the etching technique used.

In one embodiment, the alloy of the present invention can be manufactured by casting in a steel mold, without vacuum melting. For some applications, the alloys can be centrifugally cast to near-net shape parts. The casting is then cooled to room temperature at a rate of about 100° C. per minute. Higher cooling rates are desirable to eliminate as-cast segregation. The higher cooling rates are accessible through direct-chill casting where the billet is cooled, for example, with water during solidification.

It is understood that, in some embodiments, the alloy may consist of, or consist essentially of, the elemental compositions disclosed herein. It is also understood that aspects of the invention may also be embodied in a product, such as a cast product, that is formed wholly or partially of an alloy according to one or more of the embodiments described above.

Several examples of specific embodiments that were created and tested are explained in detail below, including the details of processing the embodiments and the resultant physical properties and characteristics. The prototypes evaluated in the examples below are summarized in the following table, with the balance of each alloy being copper:

TABLE 1

| Example | Bi (wt. %) | Sn (wt. %) | Sb (wt. %) | P (wt. %) | B (wt. %) | Pb (wt. %) | Other (wt. %) |
|---|---|---|---|---|---|---|---|
| 1 | 12.0 | 2.5 | 1.0 | 0.1 | 0.01 | 0.10 max | Mischmetal (0.02) |
| 2 | 12.0 | 3.0 | 1.0 | 0.1 | 0.01 | 0.10 max | Mischmetal (0.02) |
| 3 | 12.0 | 2.5 | 1.0 | 0.1 | 0.005 | 0.10 max | |
| 4 | 12.0 | 2.5 | 1.0 | 0.1 | 0.005 | 0.10 max | Mischmetal (0.02) |
| 5 | 14.1 | 5.5 | ~0 | 0.1 | <0.0003 | 0.01 max | |

EXAMPLE 1

An alloy with the nominal composition of 12.0 Bi, 2.5 Sn, 1.0 Sb, 0.1 P, 0.01B, and balance Cu, in wt %, was cast without vacuum melting. The alloy also contained mischmetal of about 0.02 wt. % to help getter impurities. The casting weighed about 36 kg and measured 42 cm in height. In a pin-on-disk friction testing at temperatures between 25 and 150° C., the alloy demonstrated lubricity comparable to a copper alloy containing ~30 wt. % Pb. The yield strength for this embodiment was about 80 to 100 MPa (12-14 ksi) and ultimate tensile strength (UTS) was about 90 to 190 MPa (13 to 28 ksi). Furthermore, the alloy showed an elongation of about 4 to 12%. FIG. 1 is an optical micrograph showing this embodiment, illustrating the Cu matrix, as well as the Bi-based second phase.

EXAMPLE 2

An alloy with the nominal composition of 12.0 Bi, 3.0 Sn, 1.0 Sb, 0.1 P, 0.01B, and balance Cu, in wt %, was cast without vacuum melting. The alloy also contained mischmetal of about 0.02 wt. % to help getter impurities. The casting weighed about 36 kg and measured 42 cm in height. In a pin-on-disk friction testing at temperatures between 25 and 150° C., the alloy demonstrated lubricity comparable to a copper alloy containing ~30 wt. % Pb. The yield strength for this embodiment was about 100 MPa (14-15 ksi) and UTS was about 110 to 180 MPa (16 to 26 ksi). Furthermore, the alloy showed an elongation of about 3 to 13%.

EXAMPLE 3

An alloy with the nominal composition of 12.0 Bi, 2.5 Sn, 1.0 Sb, 0.1 P, 0.005 B, and balance Cu, in wt %, was cast without vacuum melting. The alloy did not contain mischmetal. The casting weighed about 36 kg and measured 42 cm in height. The yield strength for this embodiment was about 100 to 110 MPa (14-16 ksi) and UTS was about 110 to 210 MPa (16 to 31 ksi). Furthermore, the alloy showed an elongation of about 5 to 20%.

EXAMPLE 4

An alloy with the nominal composition of 12.0 Bi, 2.5 Sn, 1.0 Sb, 0.1 P, 0.005 B, and balance Cu, in wt %, was cast without vacuum melting. The alloy also contained mischmetal to help getter impurities. The casting weighed about 36 kg and measured 42 cm in height. The yield strength for this embodiment was about 100 to 110 MPa (14-15 ksi) and UTS was about 150 to 180 MPa (22 to 27 ksi). Furthermore, the alloy showed an elongation of about 7 to 10%.

EXAMPLE 5

An alloy with the actual composition of 14.1 Bi, 5.5 Sn, 0.1 P, 0.01 Pb, and balance Cu, in wt %, was cast without vacuum melting. The alloy did not contain mischmetal. The casting weighed about 36 kg and measured 42 cm in height. In a pin-on-disk friction testing at temperatures between 25 and 150° C., the alloy demonstrated lubricity comparable to a copper alloy containing ~30 wt. % Pb. The yield strength for this embodiment was about 120 MPa (17 ksi) and UTS was about 120 to 130 MPa (18 ksi). Furthermore, the alloy showed an elongation of about 1 to 3%.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying claims.

What is claimed is:

1. An alloy comprising, in combination by weight:
about 12% bismuth, about 0.1% phosphorous, about 2.4% to about 3.1% tin, about 1.0% antimony, and about 0.01% boron, the balance essentially copper and incidental elements and impurities, wherein the alloy contains no more than 0.10 wt. % lead.

2. The alloy of claim 1, wherein the alloy contains less than about 0.05 wt. % lead.

3. The alloy of claim 1, further comprising at least one rare earth element in a form selected from the group consisting of: elemental lanthanum, elemental cerium, mischmetal, and any combination thereof.

4. The alloy of claim 1, wherein the alloy has a phase fraction of $Cu_3Sn$ of below about 0.15, a phase fraction of CuSb of below about 0.15, and a phase fraction of $Cu_3P$ of below about 0.01.

5. The alloy of claim 1, wherein the alloy has an ultimate tensile strength (UTS) in the range of about 90-210 MPa (13-31 ksi), a yield strength in the range of about 80-120 MPa (12-17 ksi), and an elongation in the range of about 1-20%.

6. The alloy of claim 1, wherein the alloy contains a volume fraction of a bismuth-based phase of at least 0.04.

7. An alloy consisting essentially of by weight:
about 12% bismuth;
about 0.1% phosphorous;
about 2.4 to 3.1% tin;
antimony in an amount about 1.0%;
boron in an amount 0.01%;
no more than about 0.10% lead; and
impurities, said alloy having a copper matrix microstructure with copper grain boundaries and a separate bismuth phase with a volume fraction of at least 0.04 distributed in the copper matrix generally absent segregation to the copper grain boundaries whereby said alloy is characterized by enhanced lubricity.

8. The alloy of claim 7 in combination with at least one rare earth element in a form selected from the group consisting of elemental lanthanum, elemental cerium, mischmetal and combinations thereof.

9. The alloy of claim 7 having a microstructure with an intermetallic phase fraction of $Cu_3Sn$ less than 0.15, an intermetallic phase fraction of CuSb less than 0.15 and an intermetallic phase fraction of $Cu_3P$ less than 0.01.

10. An copper-tin-bismuth alloy comprising by weight:
about 12% bismuth,
about 0.1% phosphorous,
about 2.4 to 3.1% tin,
about 1.0% antimony,
about 0.01% boron, less than about 0.05% lead, and the balance essentially copper and incidental elements, said alloy having a copper matrix microstructure of copper grains with grain boundaries and a separate bismuth phase with a volume fraction of at least 0.04absent segregation at the copper grain boundaries whereby the alloy is characterized by enhanced lubricity.

11. The alloy of claim 10 further including of at least one rare earth element in a form selected from the group consisting of elemental lanthanum, elemental cerium, mischmetal and combinations thereof.

12. The alloy of claim 10 having a microstructure with the intermetallic phase fraction of $Cu_3Sn$ less than about 0.15, an intermetallic phase fraction of CuSb less than about 0.15 and an intermetallic phase fraction of $Cu_3P$ less than about 0.01.

* * * * *